US008039774B2

(12) United States Patent
Dubey

(10) Patent No.: US 8,039,774 B2
(45) Date of Patent: Oct. 18, 2011

(54) ELECTRICAL HEATER WITH A RESISTIVE NEUTRAL PLANE

(75) Inventor: Ashish Dubey, Grayslake, IL (US)

(73) Assignee: United States Gypsum Company, Chicago, IL (US)

( * ) Notice: Subject to any disclaimer, the term of this patent is extended or adjusted under 35 U.S.C. 154(b) by 220 days.

(21) Appl. No.: 12/560,950

(22) Filed: Sep. 16, 2009

(65) Prior Publication Data

US 2010/0065542 A1 Mar. 18, 2010

Related U.S. Application Data

(60) Provisional application No. 61/097,323, filed on Sep. 16, 2008, provisional application No. 61/176,787, filed on May 8, 2009.

(51) Int. Cl.
*H05B 1/00* (2006.01)
*H01C 1/00* (2006.01)

(52) U.S. Cl. ..... 219/213; 219/483; 219/486; 219/485; 219/412; 219/497; 219/501; 219/505; 219/522; 219/203; 219/539; 219/509; 219/543; 219/544; 338/308; 338/309; 338/295; 338/306; 338/320

(58) Field of Classification Search ..... 219/213, 219/539, 509, 543, 544, 483, 485, 486, 412, 219/497, 501, 505, 522, 203; 338/325, 308, 338/309, 295, 306, 320
See application file for complete search history.

(56) References Cited

U.S. PATENT DOCUMENTS 2,680,800 A 6/1954 Chandler
2,799,764 A 7/1957 Chandler
3,417,229 A 12/1968 Shomphe et al.
3,546,432 A 12/1970 Eisler
4,229,329 A 10/1980 Bennett
4,360,554 A 11/1982 Campbell et al.
4,374,670 A 2/1983 Slocombe
(Continued)

FOREIGN PATENT DOCUMENTS

KR 10-0659599 12/2006

OTHER PUBLICATIONS

PCT International Search Report in corresponding PCT Application No. PCT/US2009/057094.

(Continued)

*Primary Examiner* — Shawntina Fuqua

(74) *Attorney, Agent, or Firm* — Greer, Burns & Crain, Ltd.; Pradip Sahu; Philip T. Petti

(57) ABSTRACT

A heating system in the form of a multi-layer, yet relatively thin and flexible panel. The panel contains a number of layers including first, second and third electrically insulating layers. A first electrically conductive resistive layer (heater layer) is sandwiched between the first and second insulating layers. A second electrically conductive resistive layer (resistive neutral plane layer) is sandwiched between the second and third insulating layers. The heater layer has a neutral electrical connection and a live electrical connection. The neutral and live electrical connections are electrically connected to each other at the panel only by electrically resistive material of the heater layer extending between the neutral and live electrical connections. The resistive neutral plane layer has a neutral electrical connection electrically connected with the neutral connection of the heater layer. The resistive neutral plane layer is electrically isolated from the live connection of the heater layer by the second insulating layer.

20 Claims, 6 Drawing Sheets

U.S. PATENT DOCUMENTS

| | | | |
|---|---|---|---|
| 4,429,214 | A | 1/1984 | Brindley et al. |
| 4,429,216 | A | 1/1984 | Brigham |
| 4,494,990 | A | 1/1985 | Harris |
| 4,588,443 | A | 5/1986 | Bache |
| 4,714,722 | A | 12/1987 | Najvar et al. |
| 4,725,632 | A | 2/1988 | Vess |
| 4,852,316 | A | 8/1989 | Webb |
| 5,192,366 | A | 3/1993 | Nishioka et al. |
| 5,308,397 | A | 5/1994 | Whatcott |
| 5,318,832 | A | 6/1994 | Fishel et al. |
| 5,346,550 | A | 9/1994 | Kunzi et al. |
| 5,401,588 | A | 3/1995 | Garvey et al. |
| 5,403,414 | A | 4/1995 | Corston |
| 5,439,518 | A | 8/1995 | Francis et al. |
| 5,481,838 | A | 1/1996 | Fishel et al. |
| 5,549,859 | A | 8/1996 | Andersen et al. |
| 5,577,158 | A | 11/1996 | Källgren et al. |
| 5,584,950 | A | 12/1996 | Gaffigan |
| 5,603,758 | A | 2/1997 | Schreifels, Jr. et al. |
| 5,725,652 | A | 3/1998 | Shulman |
| 5,894,700 | A | 4/1999 | Sweet |
| 5,924,252 | A | 7/1999 | Deike |
| 5,927,034 | A | 7/1999 | Cole |
| 5,932,124 | A | 8/1999 | Miller et al. |
| 5,932,128 | A | 8/1999 | Dishop |
| 5,940,579 | A | 8/1999 | Källgren et al. |
| 5,965,257 | A | 10/1999 | Ahluwalia |
| 6,015,965 | A | 1/2000 | Miller et al. |
| 6,017,830 | A | 1/2000 | Brown et al. |
| 6,087,630 | A | 7/2000 | Miller et al. |
| 6,124,571 | A | 9/2000 | Miller et al. |
| 6,167,668 | B1 | 1/2001 | Fine et al. |
| 6,171,388 | B1 | 1/2001 | Jobbins |
| 6,308,482 | B1 | 10/2001 | Strait |
| 6,455,615 | B2 | 9/2002 | Yu et al. |
| 6,500,560 | B1 | 12/2002 | Kiik et al. |
| 6,537,366 | B1 | 3/2003 | Supplee, Sr. |
| 6,569,923 | B1 | 5/2003 | Slagter |
| 6,586,066 | B1 | 7/2003 | Buckwalter et al. |
| 6,586,353 | B1 | 7/2003 | Kiik et al. |
| 6,599,599 | B1 | 7/2003 | Buckwater et al. |
| 6,673,177 | B2 | 1/2004 | Buckwater et al. |
| 6,720,068 | B1 | 4/2004 | Vanbemmel et al. |
| 6,803,099 | B1 | 10/2004 | Anspach |
| 6,837,014 | B2 | 1/2005 | Virtanen |
| 7,347,895 | B2 | 3/2008 | Dubey |
| 7,415,807 | B2 | 8/2008 | O'Leary et al. |
| 2002/0170648 | A1 | 11/2002 | Dinkel |
| 2003/0004246 | A1 | 1/2003 | Wache et al. |
| 2004/0077247 | A1 | 4/2004 | Schmidt et al. |
| 2004/0129365 | A1 | 7/2004 | Buckwalter et al. |
| 2004/0197544 | A1 | 10/2004 | Ramesh et al. |
| 2004/0204516 | A1 | 10/2004 | DeFord et al. |
| 2005/0214500 | A1 | 9/2005 | Hallows |
| 2006/0054059 | A1 | 3/2006 | Dubey et al. |
| 2006/0289000 | A1 | 12/2006 | Naylor |
| 2008/0020662 | A1 | 1/2008 | Strait |
| 2008/0056694 | A1 | 3/2008 | Cooper |
| 2008/0060299 | A1 | 3/2008 | Dubey et al. |
| 2008/0104917 | A1 | 5/2008 | Whelan et al. |
| 2008/0121461 | A1 | 5/2008 | Gross et al. |
| 2008/0163586 | A1 | 7/2008 | Goulet et al. |
| 2008/0176022 | A1 | 7/2008 | Payne et al. |

OTHER PUBLICATIONS

The Sydney Morning Herald; May 28, 1987; It Flies . . . Here's Concrete Evidence; Clemson University Concrete Canoe Team "Instinct".

ELECTRICAL HEATER WITH A RESISTIVE NEUTRAL PLANE

This application claims priority to provisional application Ser. No. 61/097,323 filed Sep. 16, 2008 and 61/176,787 filed May 8, 2009, and incorporated herein by reference in their entireties for all purposes. Patent application entitled "Heating System" filed simultaneously herewith and including related subject matter is also incorporated herein by reference in its entirety for all purposes.

FIELD OF THE INVENTION

The present invention relates to heating systems, and in particular, heating systems incorporated into a multi-ply panels that are relatively thin and flexible, and can be incorporated into other objects such as floors, walls or ceilings in a construction environment, or into other non-construction objects such as mirrors, picture frames, etc.

BACKGROUND OF THE INVENTION

Thin heating systems are known. Woven wire mesh heaters having no buses are made whereby thin wires are woven into a mesh mat. The mat can be placed under a laminate floor or under a subfloor or placed into non-constructions environments. However, these mats must be custom made to fit odd-sized spaces and cannot be altered at the job site. This increases the cost of the heaters and installation, and makes the process of changing the heater layout during installation significantly more difficult.

Polymer-based heaters are made using electrically resistive plastics. A conductive bus on either side of the resistance heaters completes the circuit. The result is a cuttable heating surface; however currently available products exhibit significant thickness.

Conductive ink-based heaters are made from resistive inks printed on plastic sheets. A conductive bus on either side of the resistance heaters completes the circuit. A second plastic sheet is then placed over the circuit to protect the heating elements. The result is a thin, flexible, cuttable heating surface. Conductive ink-based heaters are known for use under laminate floors, where they lay unattached in the space between the floor boards and the subfloor or, in the case of a remodel, an old floor. The plastic sheets that protect the device provide a poor surface for adhesion of ceramic tiles.

In heating elements formed on plastic sheets, there is some current leakage due to the thin nature of the sheets and capacitive effects. The magnitude of leakage current can reach to unacceptably high levels in wet environments such as in the case of flooring applications in bathrooms and kitchens. Controlling this current leakage, particularly in applications where the heating elements may be subject to high humidity or water can become problematical. The problem of electrical leakage current in wet applications has not been solved to date by the current state-of-the-art electrical and electrical heater technologies.

Damage to the thin plastic sheets could additionally result in an electrical short between some of the current carrying elements, which could also result in an unacceptable condition, such as an electrical shock or overheating of the heating elements or the plastic sheets due to high current flow.

SUMMARY OF THE INVENTION

In an embodiment of the present invention a thin, lightweight, flexible electric heater is provided that is suitable for use in dry and wet environments which has an electric leakage current measured either on a dry or a wet surface to be less than 5 mA, more preferably less than 2.5 mA, and more preferably less than 1.0 mA.

In another embodiment of the present invention an electric heater is provided that is suitable for use in dry and wet environments that has a coverage area of greater than 25 square feet, more preferably greater than 50 square feet, more preferably greater than 75 square feet, more preferably greater than 100 square feet, more preferably greater than 125 square feet, and more preferably greater than 150 square feet while maintaining the electrical leakage current values as mentioned in the above paragraph.

In another embodiment of the present invention an electric heater is provided which is suitable for use in dry and wet environments that is operable in combination with a ground fault circuit interrupter (GFCI) having a cut-off limit of 5 mA.

In another embodiment of the present invention an electric heater is provided which is suitable for use in dry and wet environments with a power density of around 50,000 watt/$m^2$of the heater area, or around 5000 watt/$m^2$of the heater area, or around 2500 watt/$m^2$of the heater area, or around 1000 watt/$m^2$of the heater area, or around 500 watt/$m^2$of the heater area, or around 250 watt/$m^2$of the heater area.

In another embodiment of the present invention an electric heater is provided which is suitable for use in construction and flooring applications in dry and wet environments and which has a power density of around 500 watt/$m^2$of the heater area, or around 300 watt/$m^2$of the heater area, or around 200 watt/$m^2$of the heater area, or around 150 watt/$m^2$of the heater area, or around 100 watt/$m^2$of the heater area.

In another embodiment of the present invention an electric heater is provided which is suitable for use in dry and wet environments which will keep the local heat flux produced by the conductive elements of the heater below 12.5 kW/$m^2$, more preferably below 4.0 kW/$m^2$, and more preferably below 2.0 kW/$m^2$ under extreme operational conditions such as in the case of an accidental short circuit.

In another embodiment of the present invention an electric heater is provided which is suitable for use in dry and wet environments that is connected to earth to make it completely safe to the users in case of accidental breach in product integrity and any ensuing current leakage.

In another embodiment of the present invention a thin, lightweight, flexible electric heater is provided which is suitable for use in dry and wet environments that can be operated using either AC current or DC current.

In another embodiment of the present invention an electric heater is provided which is suitable for use in dry and wet environments that is flexible and rollable to a diameter not exceeding 20", more preferably not exceeding 12", and more preferably not exceeding 6".

In another embodiment of the present invention an electric heater is provided which is suitable for use in dry and wet environments that is thin, with a total thickness not exceeding 1", more preferably less than 0.50", more preferably less than 0.25", and more preferably less than 0.125".

In another embodiment of the present invention an electric heater is provided which is suitable for use in dry and wet environments that is lightweight with a total product weight not exceeding 3.0 #/sq.ft., more preferably not exceeding 2.0 #/sq.ft., more preferably not exceeding 1.5 #/sq.ft., more preferably not exceeding 1.0 #/sq.ft., more preferably not exceeding 0.5 #/sq.ft.

In another embodiment of the present invention an electric heater is provided which is suitable for construction and flooring applications for use in dry and wet environments that is thin, lightweight, flexible, rollable and does not have a roll-back memory upon unfolding.

In another embodiment of the present invention an electric heater is provided which is suitable for use in construction and flooring applications in dry and wet environments for installation of ceramic tiles and natural stones such that the shear bond strength of the heater with the ceramic tiles and natural stones is greater than 50 psi, more preferably greater than 100 psi, and more preferably greater than 150 psi.

In another embodiment of the present invention an electric heater is provided which is suitable for use in dry and wet environments that can easily be cut, formed and shaped on site using commonly available tools such as scissors or utility knife.

In another embodiment of the present invention an electric heater is provided which is suitable for use in construction and flooring applications in dry and wet environments that is chemically stable under exposure to aggressive alkaline conditions such as those offered by cementitious materials (thin set mortars and tile grouts).

In another embodiment of the present invention an electric heater is provided which is suitable for use in construction and flooring applications in dry and wet environments that is bondable to a variety of substrates such as concrete, plywood, OSB, cement board, gypsum board, gypsum and cementitious poured underlayments, etc., using commonly available adhesives including cementitious mortars.

In another embodiment of the present invention an electric heater is provided for use in construction and flooring applications in dry and wet environments in which the electric heater can be rapidly installed without requiring the use of mechanical fasteners.

In an embodiment of the invention, a heating system is provided in the form of a multi-layer, yet relatively thin and flexible panel. The panel contains a number of layers including first, second and third electrically insulating layers. A first electrically conductive resistive layer is sandwiched between the first and second electrically insulating layers, such as by being printed on one of the electrically insulating layers. A second electrically conductive resistive layer is sandwiched between the second and third electrically insulating layers, such as by being printed on one of the electrically insulating layers. The first electrically conductive resistive layer has a first electrical connection (the neutral connection) and a second electrical connection (the live connection). The first and second electrical connections are electrically connected to each other at the panel only by electrically resistive material of the first electrically conductive resistive layer extending between the first and second electrical connections. The second electrically conductive resistive layer has a first electrical connection (the neutral connection) being electrically connected with the first electrical connection of the first electrically conductive resistive layer. The second electrically conductive resistive layer is electrically isolated from the second electrical connection of the first electrically conductive resistive layer by the second electrically insulating layer.

In an embodiment, the heating system further includes a fourth electrically insulating layer and a third electrically conductive resistive layer. The third electrically conductive resistive layer is sandwiched between the fourth electrically insulating layer and the first electrically insulating layer, such as by being printed on one of the electrically insulating layers, and has a first electrical connection (the neutral connection) electrically connected with the first electrical connection of the first electrically conductive resistive layer. Also, the third electrically conductive resistive layer is electrically isolated from the second electrical connection of the first electrically conductive resistive layer by the first electrically insulating layer.

In an embodiment, the heating system further includes at least one electrically conductive low resistance layer with an electrical connection (the ground connection or earth connection). The electrically conductive low resistance layer and its electrical connection are electrically isolated from the first and second electrically conductive resistive layers by one of the electrically insulating layers.

In an embodiment, the heating system further includes a fourth electrically insulating layer covering the at least one electrically conductive low resistance layer.

In an embodiment, the heating system further includes a cementitious tile membrane overlying one of the first and third electrically insulating layers.

In an embodiment, the heating system further includes a basemat layer overlying one of the first and third electrically insulating layers not overlaid by the cemetitious tile membrane.

In an embodiment, the resistive material of the second electrically conductive resistive layer has a lateral and a longitudinal extent greater than the lateral and longitudinal extent of the resistive material of the first electrically resistive layer.

In an embodiment, a floor is provided which includes a substrate, a heating system and a decorative floor surface. The heating system includes a first electrically insulating layer, a second electrically insulating layer, a third electrically insulating layer, a first electrically conductive resistive layer sandwiched between the first and second electrically insulating layers, and a second electrically conductive resistive layer sandwiched between the second and third electrically insulating layers. The first electrically conductive resistive layer has a first electrical connection and a second electrical connection. The first and second electrical connections are electrically connected to each other only by electrically resistive material of the first electrically conductive resistive layer extending between the first and second electrical connections. The second electrically conductive resistive layer has a first electrical connection electrically connected with the first electrical connection of the first electrically conductive resistive layer. The second electrically conductive resistive layer is electrically isolated from the second electrical connection of the first electrically conductive resistive layer by the second electrically insulating layer.

In an embodiment, the decorative floor surface is either laminate flooring and wood flooring.

In an embodiment, the decorative floor surface is ceramic tile or natural stone, and the floor further comprises an adhesive positioned between the substrate and the heating system and a mortar between the heating system and the ceramic tile or natural stone.

In an embodiment, the substrate is wood, cement, linoleum, ceramic tiles or natural stone or combinations thereof.

DETAILED DESCRIPTION OF THE PREFERRED EMBODIMENTS

Figure 1:
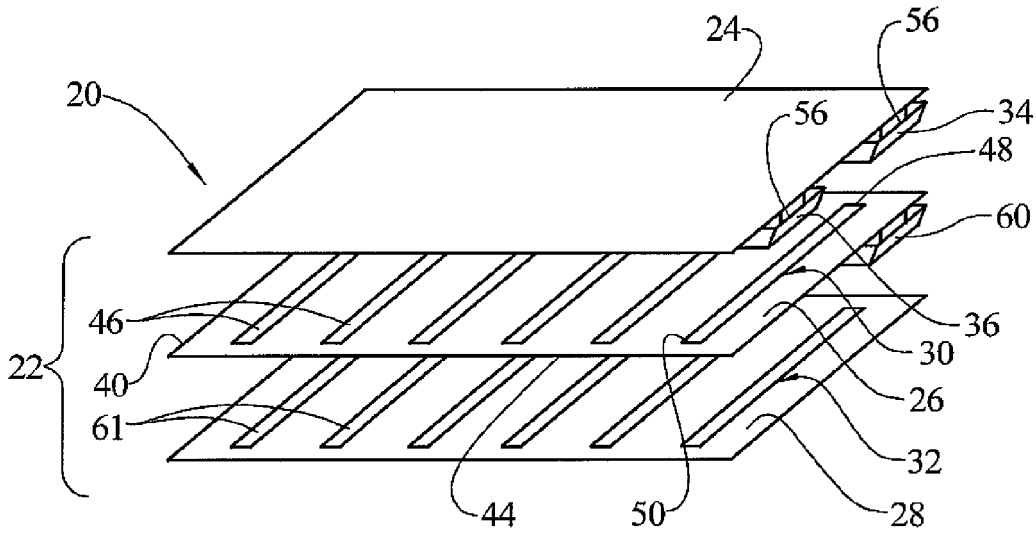
FIG. 1 is a perspective exploded view of a heating system embodying the principles of the present invention.

In an embodiment of the invention, as illustrated in FIGS. 1-4, a heating system 20 is provided in the form of a multi-layer, yet thin and flexible panel 22. The panel 22 contains a number of layers including first 24, second 26 and third 28 electrically insulating layers. These insulating layers are preferably formed of a polymer such as polyester, polypropylene, polyethylene, nylon or other polymers having a low dielectric constant. A first electrically conductive resistive layer 30 is sandwiched between the first 24 and second 26 electrically insulating layers. A second electrically conductive resistive layer 32 is sandwiched between the second 26 and third 28 electrically insulating layers. The electrically conductive resistive layers 30, 32, act as electrical resistors producing heat upon the passage of electrical current.

The first electrically conductive resistive layer 30 has a first electrical connection (neutral connection) 34 and a second electrical connection (live connection) 36. The first electrical connection 34 may comprise a bus extending along most of the length of the second electrically insulating layer 26, stopping short of each end 38, 40 of the second electrically insulating layer and being arranged parallel to, but spaced inwardly of a first longitudinal edge 42 of the second electrically insulating layer. The second electrical connection 36 may comprise a bus extending along most of the length of the second electrically insulating layer 26, stopping short of each end 38, 40 of the second electrically insulating layer and being arranged parallel to, but spaced inwardly of a second longitudinal edge 44 of the second electrically insulating layer. The first 34 and second 36 electrical connections are electrically connected to each other at the panel 22 only by electrically resistive material of the first electrically conductive resistive layer 30 extending between the first and second electrical connections. The first electrically conductive resistive layer 30 in some embodiments may be a conductive ink-based radiant heater that includes a plurality of electrically resistive ink-based strips 46 printed on the first 24 or second 26 electrically insulating layer.

Several different types of conductive ink-based radiant heaters 30 are sold commercially. One type of conductive ink-based radiant heater 30 is printed with a carbon-based ink having a variety of resistances. Another type of conductive ink-based radiant heater 30 is printed with silver-containing inks having a variety of resistances. Yet another conductive ink-based radiant heater 30 is a circuit printed onto a polyester film.

A preferred conductive ink-based radiant heater for the first electrically conductive resistive layer 30 is similar to that marketed by Calesco Norrels (Elgin, Ill.). Heating is provided by printed ink resistive strips 46 on the first 24 or second 26 electrically insulating layer which may be a polymer sheet. The resistive strips 46 are placed on the polymer sheet 24, 26 using any known method. One technique of laying down the resistive strips 46 is by printing them with a carbon-based ink. The conductive ink is selected to form a resistive material when dry and to adhere to the first polymer sheet 24, 26 so that it does not flake off or otherwise become detached when the conductive ink-based radiant heater 30 is flexed. In an embodiment, the polymer sheet 24, 26 may be made of polyester.

The electrically resistive strips 46 of the first electrically conductive resistive layer 30 may be arranged parallel to one another and may terminate at ends 48, 50 spaced from the first 42 and second 44 longitudinal edges of the first 24 or second 26 electrically insulating layer. In other embodiments, the strips 46 may criss-cross one another, or they may have a serpentine or other non-linear shape.

Figure 5:
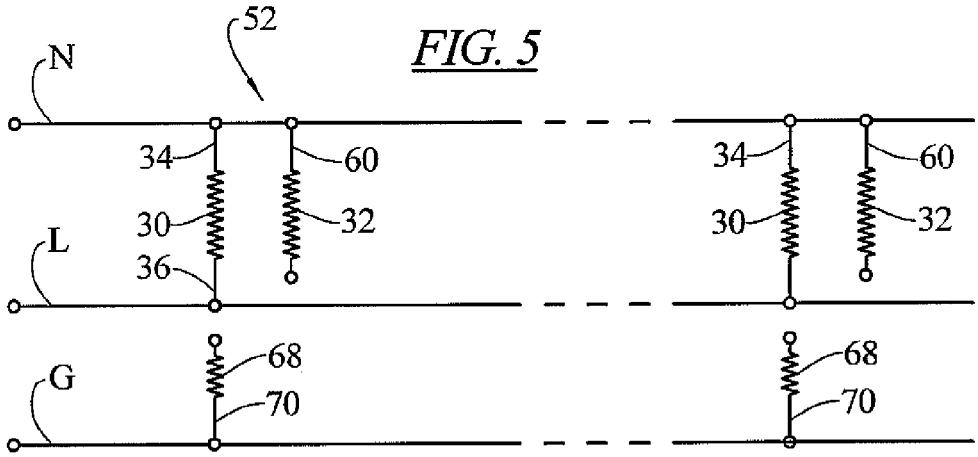
FIG. 5 is a electrical schematic of the heating system of the present invention in a circuit.

The resistive strips 46 are incorporated into an electrical circuit 52 using at least the two buses of the first 34 and second 36 electrical connections as shown in FIG. 5. One bus 34, 36 is placed at or near each end 48, 50 of the resistive strips 46 on the opposite side of the resistive strip from the first 24 or second 26 electrically insulating layer that the strips are applied to. Thus, the strips 46 are connected in parallel to each other by the buses of the first 34 and second 36 electrical connections.

Figure 6:
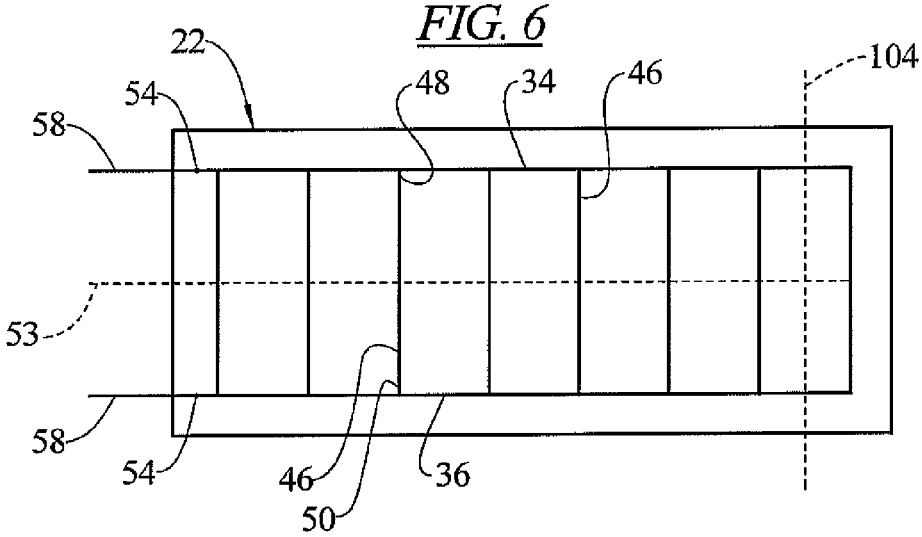
FIG. 6 is a schematic plan view of the heating panel 22.

Additional buses 53, for example connecting the mid-points of the resistive strips 46, may be added as desired (see FIG. 6). Use of additional buses in this manner minimizes the area of the sheet 22 that does not provide heat when part of a bus is cut away during fitting as described below. When an extra bus 53 is used, the central bus 53 should be connected to the live connection L of the circuit 52, and the outer buses 34, 36 should both be connected to the neutral connection N. An example of a preferred bus is a strip of copper foil or other conductive material. In an embodiment, one end 54 of the buses 34, 36 may extend all the way to the end 38 of the first 24 or second 26 electrically insulating layer to act as a conductor.

If needed, a thin conductive material 56 is placed between the resistive strips 46 and the first 34 and second 36 electrical connections where they intersect to promote good conductivity between them. Preferably the conductive material 56 is a conductive polymer. Common classes of organic conductive polymers include poly(acetylene)s, poly(pyrrole)s, poly (thiophene)s, poly(aniline)s, poly(fluorene)s, poly(3-alkylthiophene)s, polytetrathiafulvalenes, polynaphthalenes, poly (p-phenylene sulfide), and poly(para-phenylene vinylene)s.

The first 34 and second 36 electrical connections and the conductive material 56 may be bonded to the other of the first 24 or second 26 electrically insulating layer that the first electrically conductive resistive layer 30 is not applied to.

Electrical conductors 58 such as wires may extend from the first 34 and second 36 electrical connections to at least the end 38 of the panel 22 or to extend beyond the panel. The conductors 58 may also be extensions of the electrical connections 34, 36 or conductors other than wires or the buses.

The second electrically conductive resistive layer 32 has a first electrical connection 60 (neutral connection) being electrically connected with the first electrical connection 34 of the first electrically conductive resistive layer 30. The second electrically conductive resistive layer 32 is electrically isolated from the second electrical connection 36 of the first electrically conductive resistive layer 30 by the second electrically insulating layer 26. The second electrically conductive resistive layer 32 may be constructed substantially similarly to the first electrically conductive resistive layer 30, including being formed of printed strips 61, but typically has an equal or higher resistance than the resistance of the first electrically conductive resistive layer. In all other respects, such as the use of a bus as the first electrical connection 60, the use of a conductive ink and the use of a conductive material between the electrically conductive resistive layer and the first electrical connection may be the same as in the first electrically conductive resistive layer 30.

As shown in the electrical circuit diagram of FIG. 5, the first electrical connection 34 of the first electrically conductive resistive layer 30 and the first electrical connection 60 of the second electrically conductive resistive layer 32 are connected to a neutral connection N of the circuit 52, while the second electrical connection 36 of the first electrically conductive resistive layer 32 is connected to a live or hot connection L of the power circuit. With this connection, current is supplied to the first electrically conductive resistive layer 30 through the second electrical connection 36 from a circuit power supply, which may be a main electrical panel of a building. However, current is not supplied to the second electrically conductive resistive layer 32 from the circuit power supply. If any current leaks from the first electrically conductive resistive layer 30 and is intercepted by the second conductive resistive layer 32, that leaked current will be directed to the neutral connection 60 in a manner that will not cause a high current drain and build up of an excessive heat flux since the second conductive resistive layer will have a significant resistance. The second electrically conductive resistive layer 32 therefore is referred in this application as resistive neutral plane. The use of the resistive neutral plane 32 opens up an opportunity to utilize a wide range of conductive inks for designing the heating elements such that these inks provide a wider range of surface resistivity and a greater printable coverage area while simultaneously meeting the objectives of electric leakage current control and fire safety.

The resistive neutral plane 32 is instrumental in reducing the overall leakage current and preventing excessive heat buildup in the panel 22 in an event of an accidental short circuit. The resistive neutral plane 32 may be located over or under the first electrically conductive resistive layer 30. The resistive neutral plane 32 may be composed of an electrically conductive ink having high electrical resistivity. Electrically conductive inks composed of carbon particulates are examples of the preferred inks. Conductive inks comprising particulates such as silver, nickel, aluminum, and carbon, or a combination of two or more of such particulates, The electrical resistivity, width, thickness, and length of the resistive neutral plane strips 61 are specifically tailored to achieve electrical and fire safety. The fire safety is ensured by keeping the maximum heat flux generated by the conductive ink strips 61 below a predetermined limit.

It is preferred that the width of the strips 46 of the first electrically conductive resistive layer (heating element) 30 is equal to or less than the width of the strips 61 of the printed resistive neutral plane 32. Furthermore, it is also preferred that the printed conductive ink heating element 30 of the main circuit overlaps and remains completely covered by the resistive neutral plane 32. That is, in an embodiment, conductive material of the first electrically conductive resistive layer 30 has a lateral and a longitudinal extent between the first 24 and second 26 electrically insulating layers and resistive material of the second electrically conductive resistive layer 32 has a lateral and longitudinal extent at least as great as the lateral and longitudinal extent of the resistive material of the first electrically conductive resistive layer.

The first electrically conducting ink used for the first electrically conductive resistive layer 30, the second electrically conducting ink used for the second electrically conductive resistive layer 32, the width of the first electrically conductive resistive layer (heater) and the width of the second electrically conductive resistive layer (neutral plane) are selected such that the maximum heat flux produced by the heating system 20 is less than the critical radiant heat flux of the adjacent surface or the lowest critical radiant heat flux for any component material of the heating system.

When such a heating system is used in building construction, such as under a flooring application, the effects of leakage current and an accidental short circuit must be considered. The resistive neutral plane layer 32 is a conductive surface that is positioned approximately parallel to the heater layer 30. The resistive neutral plane accumulates leakage current and allows it to flow to the neutral terminal.

Relative resistivity of the resistive neutral plane layer 32 and the resistivity of the heater layer 30 are designed to minimize current, power and heat flux in the event of a short between the resistive neutral plane layer and the heater layer. If the neutral plane layer 32 is designed to have low surface resistivity, high heat flux can develop if a short occurs in the vicinity of the current source. Under certain circumstances, this can result in melting of one or more of the polymer films and/or ignition of the adjacent surface, such as a hardwood floor or wood-based subfloor. These problems are overcome by designing the heating system 20 to have a maximum heat flux which is lower than the critical heat flux of any one of the heater components or the critical heat flux of the adjacent surface. According to this invention, it is preferred to have the surface resistivity of the resistive neutral plane to be greater than 30 ohms per square, more preferably greater than 60 ohms per square, more preferably greater than 100 ohms per square, and more preferably greater than 200 ohms per square. Conductive inks providing surface resistivity of up to 2000 ohms per square can effectively be used for printing resistive neutral plane of the invention. Where it is desired to have very wide resistive neutral plane printed on the heater, conductive inks with surface resistivity of up to 2,000000 ohms per square may be used to print the resistive neutral plane of the invention.

The flexible panel 22 may be formed with a rectangular perimeter as shown in FIG. 1, or may have other shapes as desired. If formed in a rectangular shape, it may have one of a variety of different sizes, depending on the application for the panel. For example, panels may be provided having a width of 12 inches or 18 inches, or a multiple of 12 inches or 18 inches, or panels may be provided having a width of 25 centimeters or a multiple of 25 centimeters. Also, panels 22 may be provided having a length of 12 inches or 18 inches, or a multiple of 12 inches or 18 inches, or panels may be provided having a length of 25 centimeters or a multiple of 25 centimeters. Of course, other smaller or larger sizes may be selected depending on the particular application for the panels 22.

Figure 7:
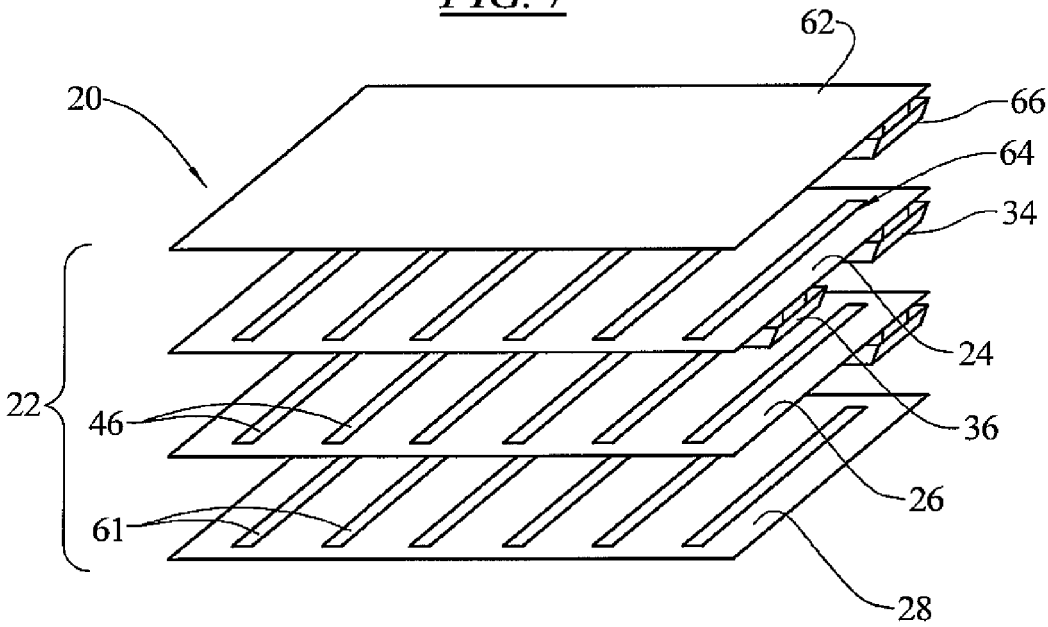
FIG. 7 is a perspective exploded view of another embodiment of a heating system embodying the principles of the present invention showing a second resistive neutral plane.
Figure 2:
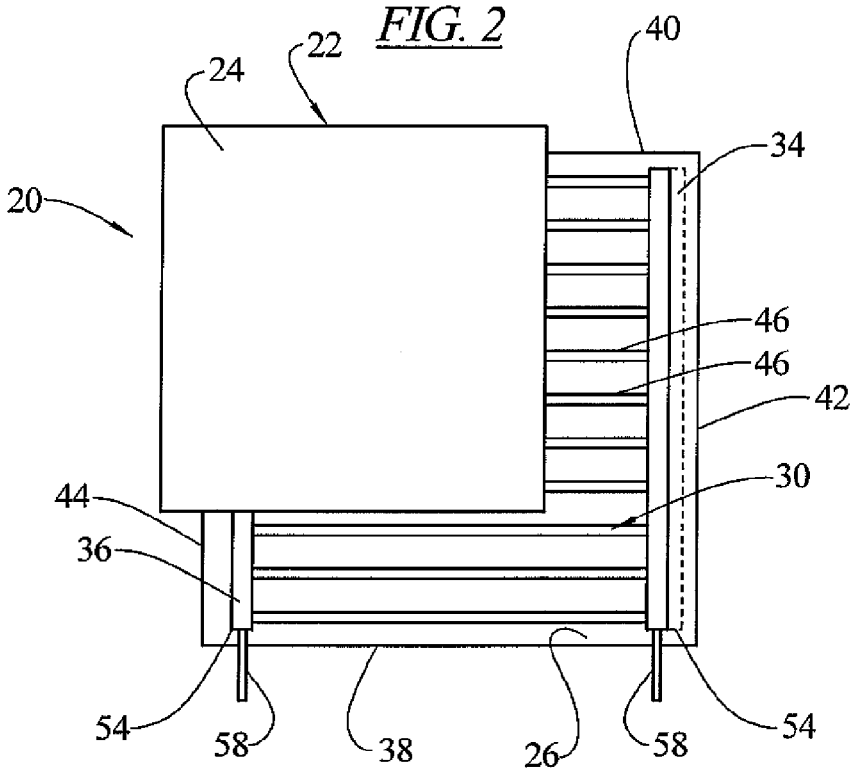
FIG. 2 is a plan view of three layers of the heating system of FIG. 1.
Figure 3:
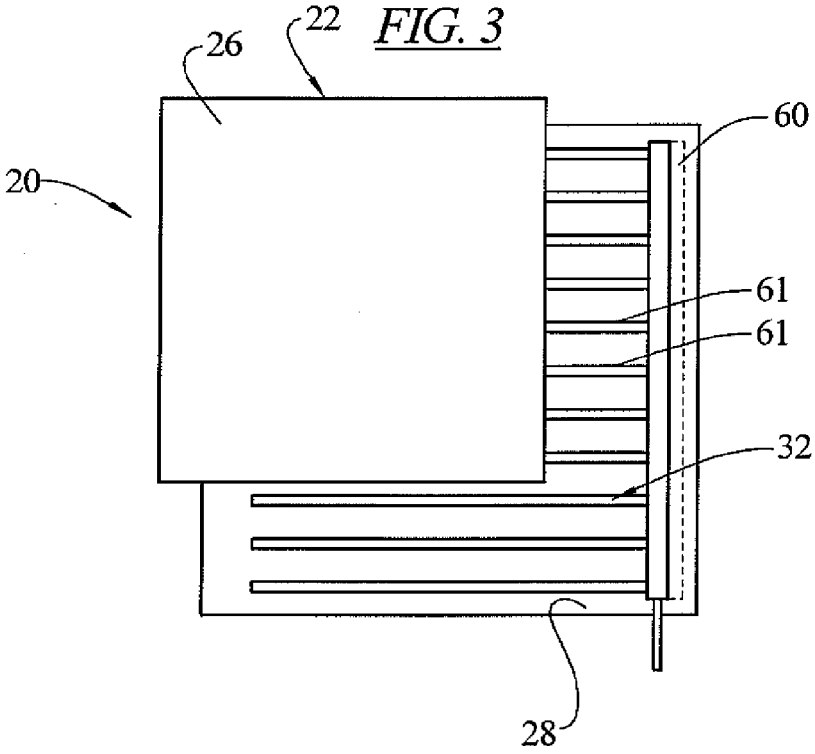
FIG. 3 is a plan view of one common and two additional layers of the heating system of FIG. 1.
Figure 4:
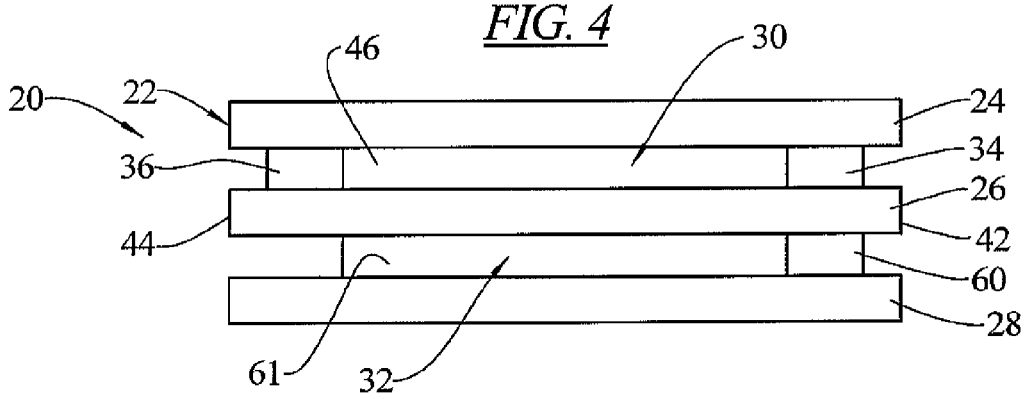
FIG. 4 is a schematic side sectional view of the heating system of FIG. 1.
Figure 8:
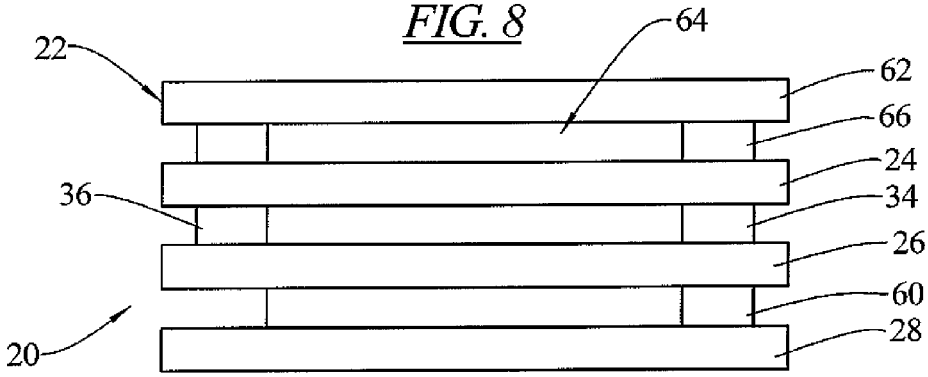
FIG. 8 is a schematic side sectional view of the heating system of FIG. 7.

In an embodiment, the heating system 20, shown in FIGS. 7 and 8, may further include a fourth electrically insulating layer 62 and a third electrically conductive resistive layer 64. The third electrically conductive resistive layer 64 is sandwiched between the fourth electrically insulating layer 62 and the first electrically insulating layer 24 and has a first electrical connection 66 electrically connected with the first electrical connection 34 of the first electrically conductive resistive layer 30. Also, the third electrically conductive resistive layer 64 is electrically isolated from the second electrical connection 36 of the first electrically conductive resistive layer 30 by the first electrically insulating layer 24 thus also making it a resistive neutral plane. The third electrically conductive resistive layer 64 may be constructed essentially identically to the second electrically conductive resistive layer 32. With the use of the third electrically conductive resistive layer 64, any current leakage in a direction opposite that of the second electrically conductive resistive layer 32 will be intercepted by the third electrically conductive resistive layer 64 and will be directed to the neutral connection in a manner that will not cause a high current drain since the third conductive resistive layer will also have a significant resistance.

Figure 9:
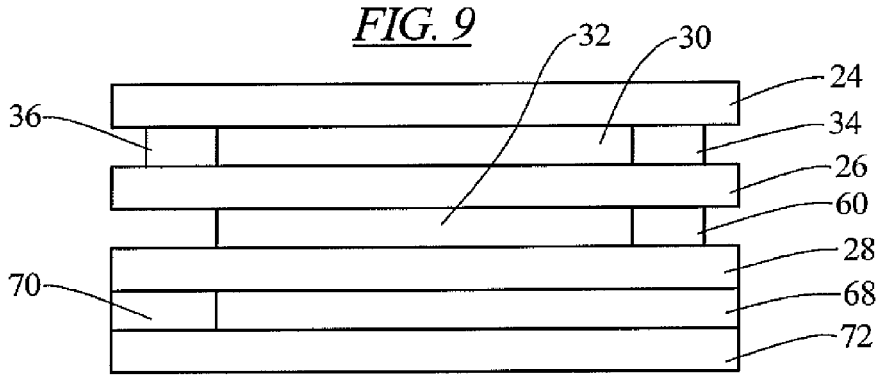
FIG. 9 is a schematic side sectional view of another embodiment of a heating system embodying the principles of the present invention showing a grounding plane.

In an embodiment as shown in FIG. 9, the heating system 20 further includes at least one electrically conductive low resistance layer 68 (grounding plane) with an electrical connection 70. The electrically conductive low resistance layer 68 may be made of materials with high electrical conductivity (low electrical resistance) such as copper, silver, aluminum, etc. The electrically conductive low resistance layer 68 and its electrical connection 70 are electrically isolated from the first 30 and second 32 electrically conductive resistive layers by one of the electrically insulating layers 24, 26, 28. The heating system 20 may further include a fourth electrically insulating layer 72 covering the at least one electrically conductive low resistance layer 68. The electrical connection 70 is to be connected to a ground connection G (FIG. 5) so that if there is any current leakage that flows to the electrically conductive low resistance layer 68, that current will be directed immediately to ground. Since the electrically conductive low resistance layer 68 is to have a resistance substantially smaller than the resistance of the first 30 or second 32 electrically conductive resistive layers, the current flow through the electrically conductive low resistance layer 68 may be much higher, leading to the tripping of any circuit breaker or ground fault interrupter that may be in the circuit 52. The electrically conductive low resistance layer 68 is designed to intercept current that has leaked due to a serious fault in the layers of the panel 22, and will usually require that the particular panel be replaced. The electrically conductive low resistance layer 68 may be constructed similarly to the electrically conductive resistive layers 30, 32, such as by printing an ink on one of the electrically insulating layers, however, the resistance of the ink forming the layer should be much less than that used for the electrically conductive resistive layers. Alternatively, thin metal foil materials (aluminum, copper, silver, etc.) laminated on polymer sheets could be used as an electrically conductive low resistance layer (grounding plane) that is connected to earth to provide electrical safety.

Figure 10:
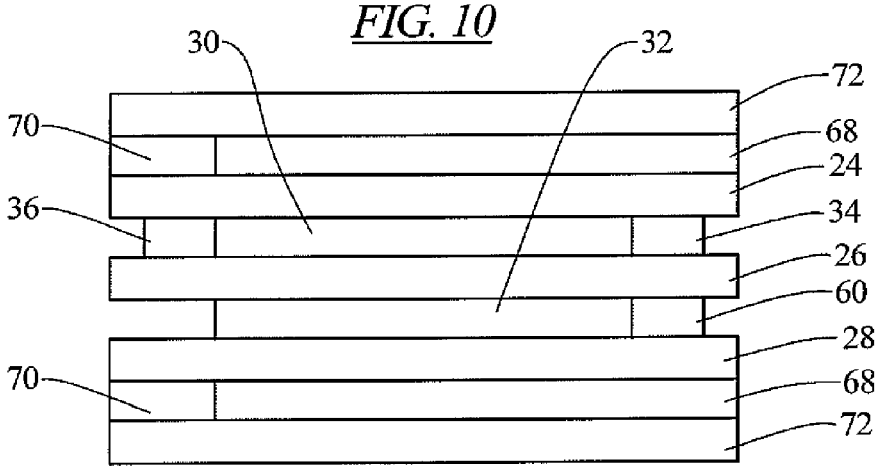
FIG. 10 is a schematic side sectional view of another embodiment of a heating system embodying the principles of the present invention showing two grounding planes.

The electrically conductive low resistance layer 68 may be placed on only one side of the panel 22, either above or below both the first 30 and second 32 electrically conductive resistive layers, depending on the installation particulars, or an electrically conductive low resistance layer 68 may be placed on both sides of the panel 22, both above and below the first 30 and second 32 electrically conductive resistive layers (FIG. 10). The electrically conductive low resistance layer 68 may be provided in the form of a wide sheet covering the entire surface of the panel or in the form of a single or multiple narrow bands that run along the length of the panel 22 in a fashion similar to the electrical buses.

Figure 11:
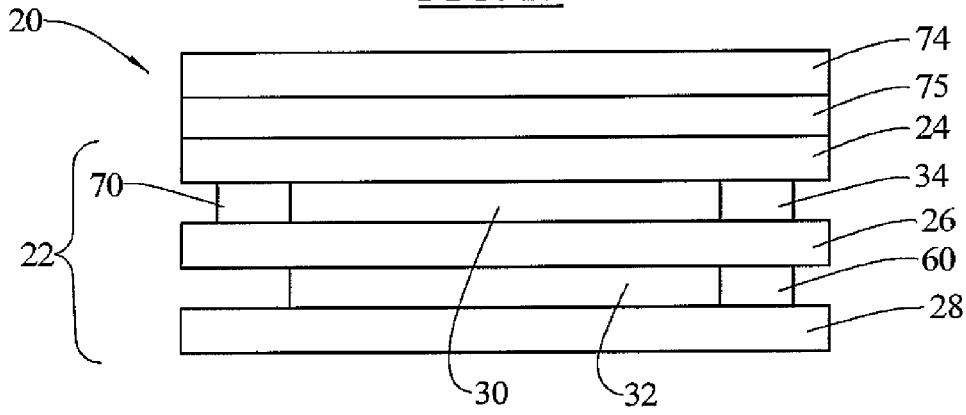
FIG. 11 is a schematic side sectional view of another embodiment of a heating system embodying the principles of the present invention showing a cementitious layer.
Figure 12:
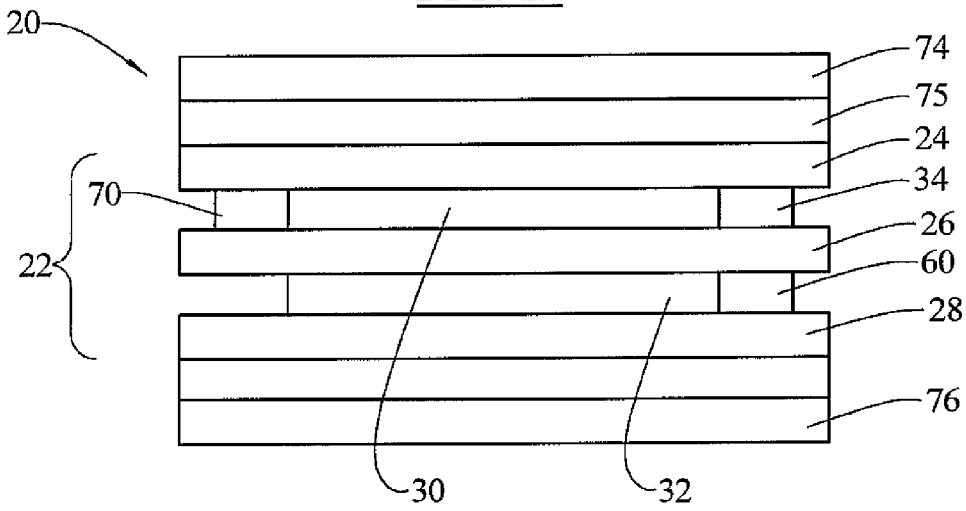
FIG. 12 is a schematic side sectional view of another embodiment of a heating system embodying the principles of the present invention showing a cementitious layer and a basemat layer.

In an embodiment as shown in FIG. 11, the heating system 20 further includes a cementitious tile membrane 74 overlying one of the first 24 and third 28 electrically insulating layers and being secured to it by an adhesive 75.

A preferred cementitious tile membrane 74 is described in U.S. Pat. No. 7,347,895, issued Mar. 23, 2008 entitled "Flexible Hydraulic Compositions," and European Patent EP179179, and in pending U.S. Patent Application US2006/0054059 published Mar. 16, 2006 entitled "Flexible and Rollable Cementitious Membrane and Method of Manufacturing It", all herein incorporated by reference in their entireties and for all purposes.

Any hydraulic components that include at least 55% fly ash may be useful in the membrane 74. Class C hydraulic fly ash, or its equivalent, is the most preferred hydraulic component. This type of fly ash is a high lime content fly ash that is obtained from the processing of certain coals. ASTM designation C-618, herein incorporated by reference, describes the characteristics of Class C fly ash (Bayou Ash Inc., Big Cajun, II, LA). When mixed with water, the fly ash sets similarly to a cement or gypsum. Use of other hydraulic components in combination with fly ash are contemplated, including cements, including high alumina cements, calcium sulfates, including calcium sulfate anhydrite, calcium sulfate hemihydrate or calcium sulfate dihydrate, other hydraulic components and combinations thereof. Mixtures of fly ashes are also contemplated for use. Silica fume (SKW Silicium Becancour, St. Laurent, Quebec, Calif.) is another preferred material. The total composition preferably includes from about 25% to about 92.5% by weight of the hydraulic component.

The polymer is a water-soluble, film-forming polymer, preferably a latex polymer. The polymer can be used in either liquid form or as a redispersible powder. A particularly preferred latex polymer is a methyl methacrylate copolymer of acrylic acid and butyl acetate (Forton VF 774 Polymer, EPS Inc. Marengo, Ill.). Although the polymer is added in any useful amount, it is preferably added in amounts of from about 5% to 35% on a dry solids basis.

In order to form two interlocking matrix structures, water must be present to form this composition. The total water in the composition should be considered when adding water to the system. If the latex polymer is supplied in the form of an aqueous suspension, water used to disperse the polymer should be included in the composition water. Any amount of water can be used that produces a flowable mixture. Preferably, about 5 to about 35% water by weight is used in the composition.

Any well-known additives for cements or polymer cements can be useful in any of the embodiments of the instant composition to modify it for a specific purpose of application. Fillers are added for a variety of reasons. The composition or finished product can be made even more lightweight if lightweight fillers, such as expanded perlite, other expanded materials or either glass, ceramic or plastic microspheres, are added. Microspheres reduce the weight of the overall product by encapsulating gaseous materials into tiny bubbles that are incorporated into the composition thereby reducing its density. Foaming agents used in conventional amounts are also useful for reducing the product density.

Conventional inorganic fillers and aggregates are also useful to reduce cost and decrease shrinkage cracking. Typical fillers include sand, talc, mica, calcium carbonate, calcined clays, pumice, crushed or expanded perlite, volcanic ash, rice husk ash, diatomaceous earth, slag, metakaolin, and other pozzolanic materials. Amounts of these materials should not exceed the point where properties such as strength are adversely affected. When very thin membranes or underlayments are being prepared, the use of very small fillers, such as sand or microspheres are preferred.

Colorants are optionally added to change the color of the composition of finished membrane 74. Fly ash is typically gray in color, with the Class C fly ash usually lighter than Class F fly ash. Any dyes or pigments that are compatible with the composition may be used. Titanium dioxide is optionally used as a whitener. A preferred colorant is Ajack Black from Solution Dispersions, Cynthiana, Ky.

Set control additives that either accelerate or retard the setting time of the hydraulic component are contemplated for use in these compositions. The exact additives will depend on the hydraulic components being used and the degree to which the set time is being modified.

Reinforcing materials can be used to add strength to the membrane 74. The additional of fibers or meshes optionally help hold the composition together. Steel fibers, plastic fibers, such as polypropylene and polyvinyl alcohols, and fiberglass are recommended, but the scope of reinforcing materials is not limited hereby.

Superplasticizer additives are known to improve the fluidity of a hydraulic slurry. They disperse the molecules in solution so that they move more easily relative to each other, thereby improving the flowability of the entire slurry. Polycarboxylates, sulfonated melamines and sulfonated naphthalenes are known as superplasticizers. Preferred superplasticizers include ADVA Cast by Grace Construction Products, Cambridge, Mass. and Dilflo GW Superplasticizer of Geo Specialty Chemicals, Cedartown, Ga. The addition of these materials allows the user to tailor the fluidity of the slurry to the particular application.

Shrinkage reducing agents help decrease plastic shrinkage cracking as the coating of the membrane 74 dries. These generally function to modify the surface tension so that the slurry flows together as it dries. Glycols are preferred shrinkage reducing agents.

In an embodiment, the heating system 20 further includes a basemat layer 76 overlying one of the first 24 and third 28 electrically insulating layers not overlaid by the cemetitious tile membrane 74.

Figure 13:
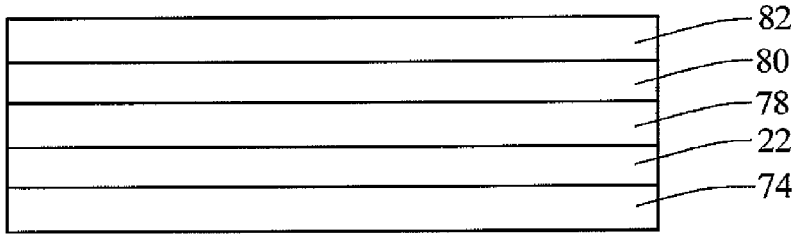
FIG. 13 is a schematic side sectional view of the embodiment of FIG. 12, showing detail of the basemat layer.

A preferred basemat layer 76 for the heating system 20 may include at least a first spunbond lamina 78 (FIG. 13). The first spunbond lamina 78 is optionally bonded directly to the heating system panel 22. In other embodiments, an optional meltblown lamina 80 resists migration of liquids through the basemat layer 76, adding to the resistance to the flow of water or other liquids across the basemat layer 76. The first spunbond lamina 78 is placed on the top side of the meltblown lamina 80 to provide high porosity on at least one surface of the basemat layer 76. Porosity of the spunbond material allows for good infiltration and absorption of mortar if the panel is incorporated into a tiled floor. The large fibers become incorporated into the crystal matrix of the mortar, forming a strong bond.

Optionally, a second spunbond lamina 82 is present on the meltblown lamina 80 on the surface opposite that facing the first spunbond lamina 78. In this embodiment, the meltblown lamina 80 is sandwiched between the first spunbond lamina 78 and the second spunbond lamina 82. This embodiment has the advantage that it has the same surface on both sides and it does not matter which surface is applied to the heater panel 22 and which surface is facing a new decorative flooring or other surface.

The laminae 78, 80, 82 are bonded to each other by any suitable means. Three-ply composites or this type are commercially available as an S-M-S laminate by Kimberly-Clark, Roswell, Ga. This product is made of polypropylene fibers. While providing a barrier to liquids, the material is still breathable, allowing water vapor to pass through it. Depending upon the end application and the performance requirements, other lamina may be more suitable for a particular application. U.S. Pat. No. 4,041,203, herein incorporated by reference, fully describes an S-M-S laminate and a method for making it.

Figure 14:
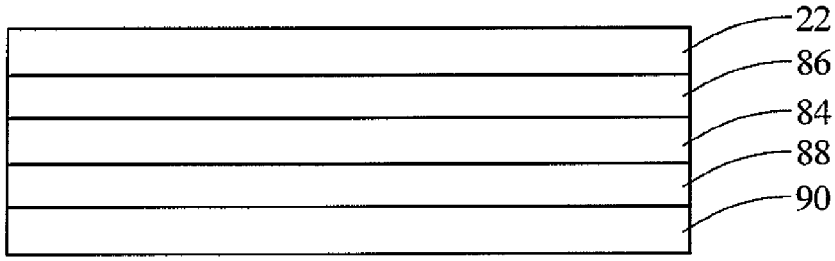
FIG. 14 is a schematic side sectional view of another embodiment of a heating system embodying the principles of the present invention showing a functional layer and a self-stick adhesive layer.

An alternate embodiment of the heating system is illustrated in FIG. 14. In this embodiment, there are multiple layers as described above and a new functional layer 84 is provided and adhered to the panel 22 via an adhesive layer 86 which may provide a single function or multiple functions.

For example, layer 84 may have sound suppression properties, it may comprise thermal insulation, it may comprise electrical insulation, it may provide waterproofing and it may provide enhanced crack isolation. Further, this layer 84 may provide more than one of the above properties by means of individual component layers or more than one of these properties might be provided in a single layer.

As examples of possible components comprising the functional layer 84, the sound suppression properties, particularly for impact noise, could be achieved with a layer of low density foam, rubber or plastic. The adhesive layer 86 securing the functional layer 84 to the panel 22 could be pressure sensitive adhesive transfer tape or pressure sensitive double sided adhesive tape or even spay or liquid applied adhesives. The use of double sided adhesive tapes are preferred when enhanced crack-isolation and waterproofing performance are desired. Low density foams, which also may provide thermal insulation and/or electrical insulation, may include polyethylene foams such as 3M polyethylene foam tape 4462 or 4466, polyurethane foams such as 3M urethane foam tape 4004 or 4008, polyvinyl foams such as 3M polyvinyl foam tape 4408 or 4416, ethylene vinyl acetate foams such as International Tape Company polyethylene foam tapes 316 or 332, acrylic foams such as 3M VHB 4941 closed-cell acrylic foam tape family, and EPDM (ethylene propylene diene monomer) foams such as Permacel EE1010 closed cell EPDM foam tape. Silicone foams include Saint-Gobain 512AV.062 and 512AF.094 foam tapes. Rubber foams include 3M 500 Impact stripping tape and 510 Stencil tape. Elastomeric foams include 3M 4921 elastomeric foam tape and Avery Dennison XHA 9500 foam tape. Rubber or recycled rubber sheets can be obtained from Amorim Industrial Solutions or IRP Industrial Rubber.

The use of an adhesive layer 88 and a release sheet 90 allows the panels 22 to be self-adhering to a desired substrate surface, in the nature of a peal and stick arrangement. This permits the installer to quickly place the panels in their desired locations without the need for mixing or applying adhesive materials and assures that the adhesives adequately cover the panels and are applied in the correct amounts.

Figure 15:
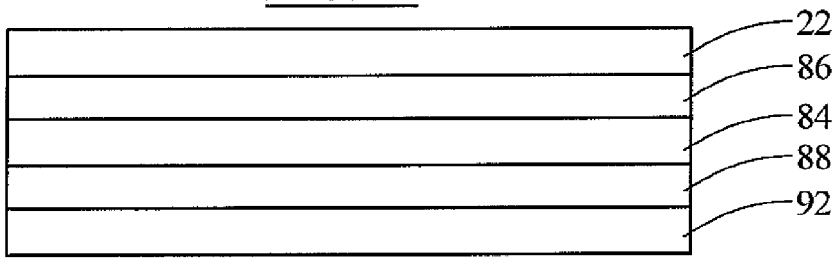
FIG. 15 is a schematic side sectional view of another embodiment of a heating system embodying the principles of the present invention showing a rigid panel composite layer.

A further embodiment of the invention is illustrated in FIG. 15 which has all of the layers described with respect to FIG. 14 (other than the release sheet 90). In addition, this embodiment includes a rigid panel composite layer 92 by means of which the heating system 20 is provided on a building panel that can be incorporated into floors, walls, ceilings and other structural components of a building. The rigid panel composite layer 92 may comprise mesh reinforced cement board, fiber reinforced cement board, gypsum panels, gypsum fiber panels, plywood, oriented strand board or other types of wood-based panels, plastic panels as well as other types of rigid panel composites. The panel thicknesses may range between 0.125 to 10 inches, preferably between 0.250 to 2 inches and most preferably between 0.250 and 1 inches.

Figure 16:
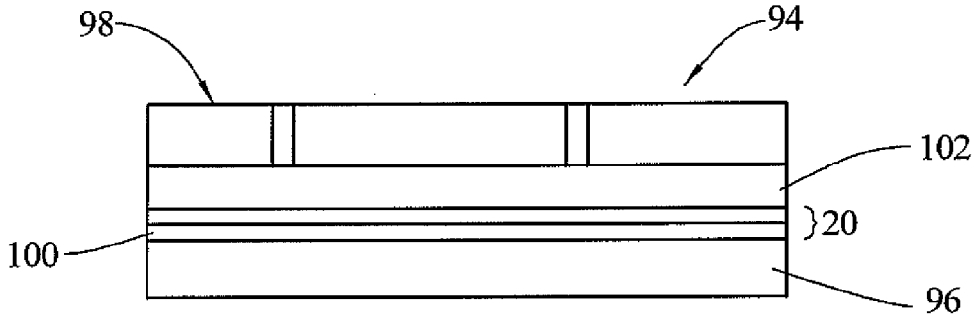
FIG. 16 is a schematic side sectional view of a heated floor using the heating system of the present invention.

In an embodiment as shown in FIG. 16, a floor 94 is provided which includes a substrate 96, a heating system 20 and a decorative floor surface 98. The heating system 20 is as described above. The decorative floor surface 98 may be laminate flooring, wood flooring, ceramic tile or natural stone. The floor further comprises an adhesive 100 positioned between the substrate 96 and the heating system 20 and a mortar 102 between the heating system and the ceramic tile or natural stone. The substrate 96 may be wood, cement, linoleum, ceramic tiles, natural stone or combinations thereof.

It is contemplated that the heating system 20 be made in certain standard sizes. For areas larger than the largest available heating system size, two or more panels 22 are attachable to each other so that the live bus connection 36 from one heater supplies current to the live bus connection of one or more adjacent panels. The respective neutral connections 34, 60 are similarly in electrical communication with each other. This technique allows for creation of a warming surface for virtually any size room.

An advantage of the present heater is that it is cuttable and shapable in the field as the flooring system is being installed. The panels 22 of the heating system 20 can be trimmed to fit areas of any shape and do not have to be custom made. At the time of installation, the heater can be cut to accommodate, for example, heating and cooling vents, plumbing fixtures and base cabinets of varying shapes. Although some of the individual heating strips 46 will fail to provide heat, the uncut heating strips will continue to warm the adjacent surface. If the panels 22 need to be cut to fit a particular installation requirement, the panels are to be cut along a line (such as line 104 in FIG. 6) parallel to the resistive strips 46, in those embodiments where the strips are spaced and parallel to each other. This will result in two exposed portions of the buses 34, 36 which will need to be insulated and isolated from the cut edge of the panel, such as with insulating tape, a liquid non-conductive polymer, or other known methods of electrical insulation. If the size of the installation requires cutting of the panel 22 along its length (cutting though all of the resistive strips 46), then it is preferred to obtain a narrower prefabricated panel, or to limit the area under the floor provided with the heater, in order to avoid having to electrically insulate the large number of exposed ends of the cut strips. Since the panels 22 are to be joined together in a circuit with parallel connections (see FIG. 5), extra panels can be added as needed.

Many variations of the panel 22 may be developed with the use of various of the different layers described above in other combinations than those described herein. Although some layers have been shown as used only with the single heating 30 and resistive neutral plane 32 layers, they may be combined with other layers described above to provide a particular panel that has the functionality desired.

While particular embodiments of the heater with a resistive neutral plane have been shown and described, it will be appreciated by those skilled in the art that changes and modifications may be made thereto without departing from the invention in its broader aspects. Any of the options and layers revealed herein may be used with any other option or layer unless otherwise noted.

What is claimed is:

1. A heating system in the form of a multi-layer panel comprising:

a first electrically insulating layer;

a second electrically insulating layer;

a third electrically insulating layer;

a first electrically conductive resistive layer sandwiched between said first and second electrically insulating layers;

a second electrically conductive resistive layer sandwiched between said second and third electrically insulating layers;

said first electrically conductive resistive layer having a first electrical connection and a second electrical connection, said first and second electrical connections being electrically connected to each other only by electrically resistive material of said first electrically conductive resistive layer extending between said first and second electrical connections;

said second electrically conductive resistive layer having a first electrical connection being electrically connected with said first electrical connection of said first electrically conductive resistive layer; and said second electrically conductive resistive layer being electrically isolated from said second electrical connection of said first electrically conductive resistive layer by said second electrically insulating layer.

2. The heating system of claim 1 further including a fourth electrically insulating layer and a third electrically conductive resistive layer, the third electrically conductive resistive layer being sandwiched between the fourth electrically insulating layer and the first electrically insulating layer and having a first electrical connection being electrically connected with said first electrical connection of said first electrically conductive resistive layer and said third electrically conductive resistive layer being electrically isolated from said second electrical connection of said first electrically conductive resistive layer by said first electrically insulating layer.

3. The heating system of claim 1 further including at least one electrically conductive low resistance layer with an electrical connection, the electrically conductive low resistance layer and its electrical connection being electrically isolated from said first and second electrically conductive resistive layers by one of said electrically insulating layers.

4. The heating system of claim 3 further including a fourth electrically insulating layer covering said at least one electrically conductive low resistance layer.

5. The heating system of claim 1 further including a cementitious tile membrane overlying one of said first and third electrically insulating layers.

6. The heating system of claim 5 further including at least one electrically conductive low resistance layer with an electrical connection, the electrically conductive low resistance layer and its electrical connection being electrically isolated from said first and second electrically conductive resistive layers by one of said electrically insulating layers.

7. The heating system of claim 5 further including a basemat layer overlying one of said first and third electrically insulating layers not overlaid by said cemetitious tile membrane.

8. The heating system of claim 3, wherein said resistive material of said electrically conductive low resistance layer has a lateral and a longitudinal extent greater than said lateral and longitudinal extent of said resistive material of said first and second electrically resistive layers.

9. The heating system of claim 1, wherein conductive material of said first electrically resistive layer has a lateral and a longitudinal extent between said first and second electrically insulating layers and resistive material of said second electrically resistive layer has a lateral and longitudinal extent at least as great as said lateral and longitudinal extent of said resistive material of said first electrically resistive layer.

10. The heating system of claim 1, wherein each of the first, second and third electrically insulating layers, and the first and second electrically conductive resistive layers are thin and flexible, such that when combined into the multi-layer panel, the panel itself is thin and flexible.

11. The heating system of claim 1, wherein said first electrically conductive resistive layer comprises a series of electrically resistive ink strips printed on one of said first and second electrically insulating layers and said second electrically conductive resistive layer comprises a series of electrically resistive ink strips printed on one of said second and third electrically insulating layers.

12. The heating system of claim 11, wherein a width of the individual strips of the second electrically conductive resistive layer is wider than a width of the individual strips of the first electrically conductive resistive layer.

13. The heating system of claim 1, wherein the resistance of said second electrically conductive resistive layer is greater than the resistance of said first electrically conductive resistive layer.

14. The heating system of claim 1, wherein the first, second and third electrically insulating layers comprise polymer sheets.

15. The heating system of claim 1, further comprising a multi-functional layer that is adhered to the multi-ply panel using an adhesive.

16. The heating system of claim 15, wherein said multi-functional layer comprises one of the group consisting of a low density foam, a polymeric sheet, a rubber sheet and combinations thereof.

17. A floor comprising:

a substrate;

a heating system comprising:

a first electrically insulating layer;

a second electrically insulating layer;

a third electrically insulating layer;

a first electrically conductive resistive layer sandwiched between said first and second electrically insulating layers;

a second electrically conductive resistive layer sandwiched between said second and third electrically insulating layers;

said first electrically conductive resistive layer having a first electrical connection and a second electrical connection, said first and second electrical connections being electrically connected to each other only by electrically resistive material of said first electrically conductive resistive layer extending between said first and second electrical connections;

said second electrically conductive resistive layer having a first electrical connection being electrically connected with said first electrical connection of said first electrically conductive resistive layer; and said second electrically conductive resistive layer being electrically isolated from said second electrical connection of said first electrically conductive resistive layer by said second electrically insulating layer; and a decorative floor surface.

18. The floor of claim 17 wherein said decorative floor surface is selected from the group consisting of laminate flooring and wood flooring.

19. The floor of claim 17 wherein said decorative floor surface is ceramic tile, and wherein said floor further comprises an adhesive positioned between said substrate and said heating system and a mortar between said heating system and said ceramic tile.

20. The floor of claim 17 wherein said substrate is one selected from the group consisting of wood, cement, linoleum, ceramic tiles and combinations thereof.

* * * * *